US011370222B2

(12) United States Patent
Hayashi et al.

(10) Patent No.: US 11,370,222 B2
(45) Date of Patent: Jun. 28, 2022

(54) LIQUID SUPPLY DEVICE, PRINTER, AND PRINTER SYSTEM

(71) Applicant: SEIKO EPSON CORPORATION, Tokyo (JP)

(72) Inventors: Seiya Hayashi, Matsumoto (JP); Akira Mashima, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 79 days.

(21) Appl. No.: 16/897,904

(22) Filed: Jun. 10, 2020

(65) Prior Publication Data

US 2020/0391515 A1 Dec. 17, 2020

(30) Foreign Application Priority Data

Jun. 11, 2019 (JP) ..... JP2019-108498

(51) Int. Cl.
*B41J 2/175* (2006.01)

(52) U.S. Cl.
CPC ..... *B41J 2/17523* (2013.01); *B41J 2/17553* (2013.01)

(58) Field of Classification Search
CPC .. B41J 2/17523; B41J 2/17553; B41J 2/1752; B41J 29/13; B41J 2/17509
USPC ..... 347/86
See application file for complete search history.

(56) References Cited

U.S. PATENT DOCUMENTS

2005/0093940 A1* 5/2005 Tanno ..... B41J 2/17523 347/85
2005/0168545 A1* 8/2005 Sakai ..... B41J 2/1752 347/86
2011/0063387 A1 3/2011 Ogle et al.
2013/0187993 A1* 7/2013 Aoki ..... B41J 2/17503 347/86

* cited by examiner

*Primary Examiner* — Kristal Feggins
*Assistant Examiner* — Alexander D Shenderov
(74) *Attorney, Agent, or Firm* — Workman Nydegger

(57) ABSTRACT

A liquid supply device for use in a printer is provided, which includes a mounting base on which a storing body filled with liquid is mountable, a tube capable of supplying the liquid from the storing body to the printer, a connector coupled to the tube and configured to be detached from the storing body, and moreover provided with a grip portion, and a cover configured to move to a first position for covering the grip portion and a second position for not covering the grip portion, in a state in which the connector is attached to the storing body mounted on the mounting base.

9 Claims, 7 Drawing Sheets

LIQUID SUPPLY DEVICE, PRINTER, AND PRINTER SYSTEM

The present application is based on, and claims priority from JP Application Serial Number 2019-108498, filed Jun. 11, 2019, the disclosure of which is hereby incorporated by reference herein in its entirety.

BACKGROUND

1. Technical Field

The present disclosure relates to a liquid supply device, a printer including this liquid supply device, and a printer system including this liquid supply device.

2. Related Art

In the past, for example, a liquid supply device having a bag-in-box type ink container (hereinafter, referred to as a BIB type storing body) containing an ink pack inside a case formed of cardboard or the like has been known (for example, U.S. Patent Application No. 2011/0063387).

The liquid supply device described in U.S. Patent Application No. 2011/0063387 is provided with a mounting base on which a BIB type storing body is mounted, a connector coupled to the BIB type storing body, and a tube coupled to the connector for supplying ink to the BIB type storing body.

However, in the liquid supply device described in U.S. Patent Application No. 2011/0063387, the connector coupled to the BIB type storing body is exposed, thus when extra force is applied to this connector, coupling between the BIB type storing body and the connector is released, and there was a possibility that the ink may leak out of the BIB type storing body.

SUMMARY

A liquid supply device of the present application is a liquid supply device for use in a printer, that includes a mounting base on which a storing body filled with liquid is mountable, a tube capable of supplying the liquid from the storing body to the printer, a connector coupled to the tube and configured to be detached from the storing body, and moreover provided with a grip portion, and a cover configured to move to a first position for covering the grip portion and a second position for not covering the grip portion, in a state in which the connector is attached to the storing body mounted on the mounting base.

In the above liquid supply device, the cover may move to the first position and the second position by the cover rotating relative to the mounting base.

In the above liquid supply device, the cover may be configured to support, at the second position, the connector detached from the storing body mounted on the mounting base.

The above liquid supply device may include a support portion that supports the mounting base from lower side in a height direction, the support portion may be provided with a wall portion extending upward in the height direction, and the wall portion may be provided with a regulating portion configured to contact with the cover, and to regulate contact of the cover with the connector coupled to the storing body at the first position.

In the above liquid supply device, the mounting base may be provided with a second regulating portion that abuts on the storing body mounted on the mounting base and is capable of regulating movement of this storing body.

A printer system of the present application includes a liquid supply device including a mounting base on which a storing body filled with liquid is mountable, a tube capable of supplying the liquid from the storing body, a connector coupled to the tube and configured to be detached from the storing body, and moreover provided with a grip portion, and a cover configured to move to a first position for covering the grip portion and a second position for not covering the grip portion, in a state in which the connector is attached to the storing body mounted on the mounting base, and a printer including a discharging unit configured to discharge liquid, supplied from the liquid supply device, onto a medium.

The above printer system may include a control device configured to control supply of the liquid to the printer, the liquid supply device may include a detector configured to detect a position of the cover, the control device may, when the detector detects that the cover moved to the second position, stop supply of the liquid from the storing body to the printer.

In the above printer system, when the storing body is a first storing body a second storing body is mountable on the mounting base, and the control device may control the liquid supply device so as to switch, when the detector detects that the cover moved to the second position, from the first storing body to the second storing body, a source of the supply of the liquid to the printer.

A printer of the present application includes a mounting base on which a storing body filled with liquid is mountable, a tube capable of supplying the liquid from the storing body, a connector coupled to the tube and configured to be detached from the storing body, and moreover provided with a grip portion, a cover configured to moce to a first position for covering the grip portion and a second position for not covering the grip portion, in a state in which the connector is attached to the storing body mounted on the mounting base, and a discharging unit configured to discharge the liquid supplied from the storing body onto a medium.

DESCRIPTION OF EXEMPLARY EMBODIMENTS

Exemplary embodiments of the disclosure are described below with reference to the accompanying drawings. The exemplary embodiments each illustrate an aspect of the disclosure, and do not limit the disclosure in any way. The exemplary embodiments can be changed as desired without departing from the scope of the technical concept of the disclosure. Moreover, in each of the following figures, to make each layer, and each portion recognizable in terms of size, each layer and portion is illustrated at a scale different from an actual scale.

Exemplary Embodiment

Figure 1:
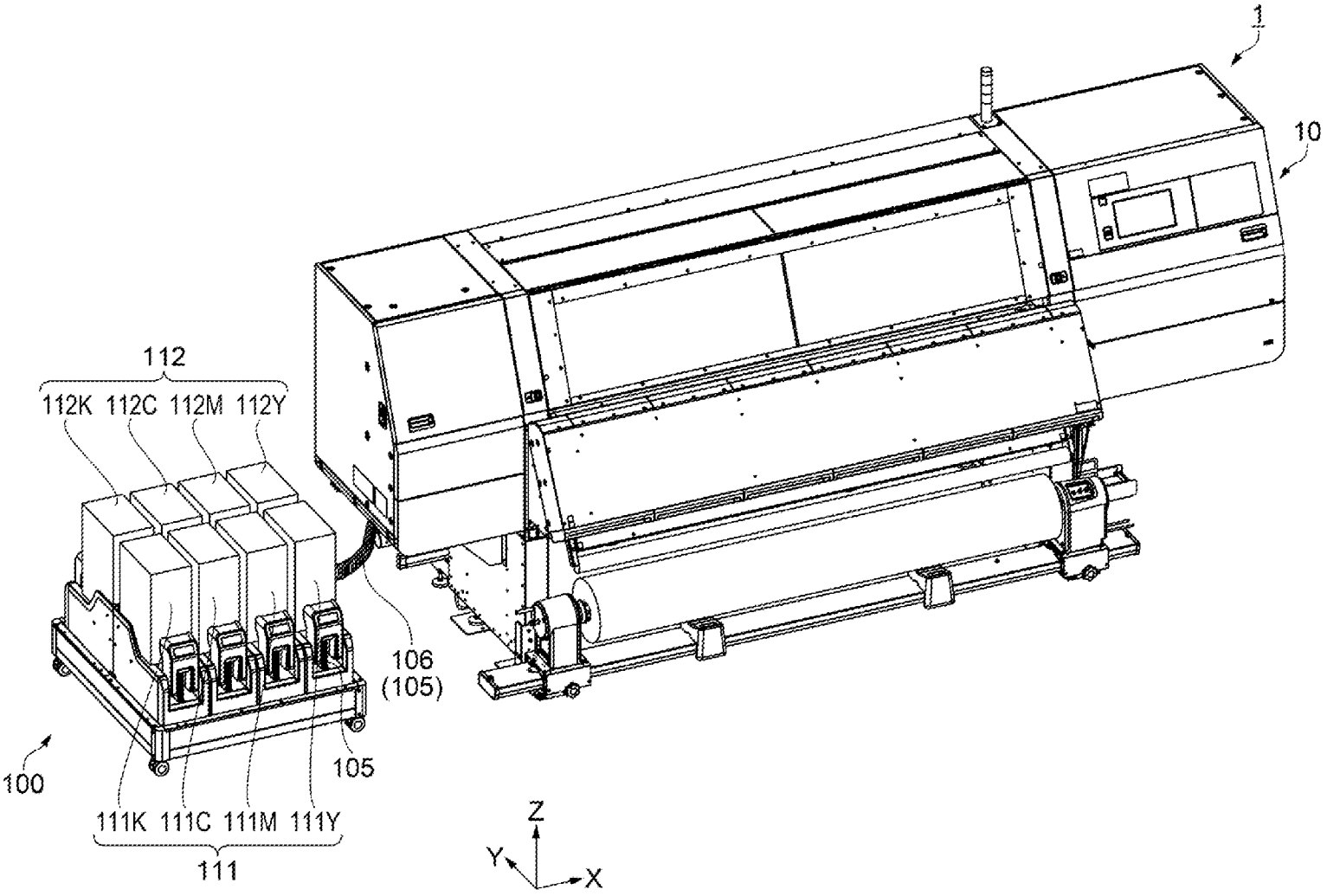
FIG. 1 is a perspective view illustrating an overview of a printer system according to an exemplary embodiment.
Figure 2:
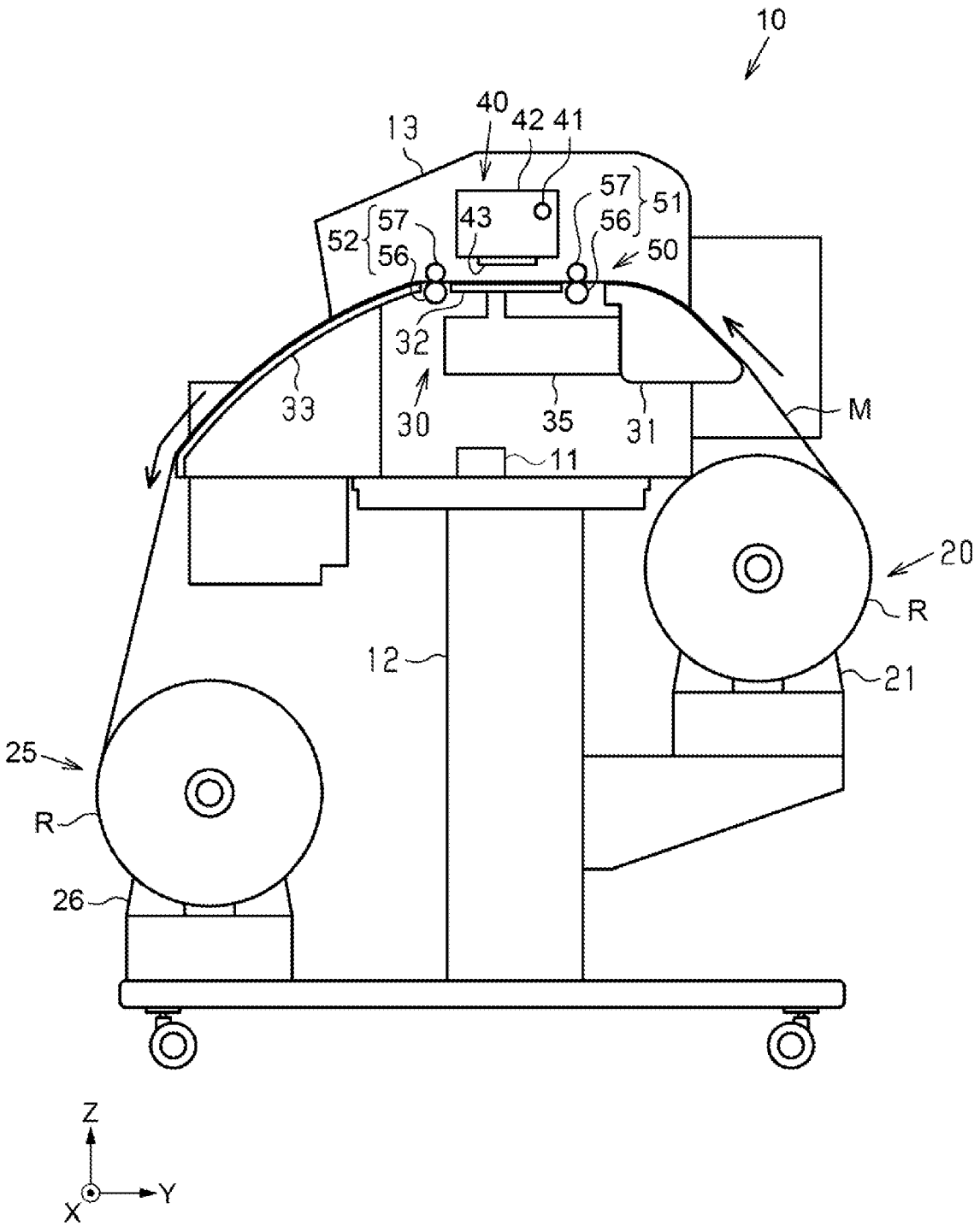
FIG. 2 is a cross-sectional view of a main portion illustrating an overview of a printer included in the printer system according to the exemplary embodiment.

FIG. 1 is a perspective view illustrating an overview of a printer system 1 according to an exemplary embodiment. FIG. 2 is a cross-sectional view of a main portion illustrating an overview of a printer 10 included in the printer system 1 according to the exemplary embodiment.

Firstly, with reference to FIG. 1 and FIG. 2, the overview of the printer system 1, and the printer 10 included in the printer system 1 according to the present exemplary embodiment will be described. Further, explanation of a liquid supply device 100 included in the printer system 1 according to the present exemplary embodiment will be described later.

As illustrated in FIG. 1, the printer system 1 according to the present exemplary embodiment includes the liquid supply device 100 for supplying ink that is an example of liquid, to the printer 10, and the printer 10 including a discharging unit for discharging the ink supplied from the liquid supply device 100 onto a medium M. Further, the printer 10 according to the present exemplary embodiment is a large format printer for transporting the medium M in a roll-to-roll manner, and printing an image on the medium M with a large size of an A0 size or a B1 size.

In the following description, a width direction (longitudinal direction) of the printer 10 is defined as an X direction, a depth direction (short direction) of the printer 10 is defined as a Y direction, and a height direction of the printer 10 is defined as a Z direction. Further, a tip side of an arrow indicating a direction is defined as a + direction, and a base end side of the arrow indicating the direction is defined as a − direction.

As illustrated in FIG. 2, the printer 10 includes a housing 13 supported by a foot 12. The printer 10 includes a control device 11 disposed inside the housing 13. The control device 11 includes a CPU, a memory, and the like, and controls each unit of the printer 10. In addition, the control device 11 controls supply of ink from the liquid supply device 100.

Furthermore, the printer 10 includes a feeding portion 20 for feeding the medium M from an outside of the housing 13 toward an inside of the housing 13, and a support portion 30 for supporting the medium M fed by the feeding portion 20. Furthermore, the printer 10 includes a transport unit 50 for transporting the medium M along the support portion 30, a printing unit 40 for printing onto the medium M supported by the support portion 30, and a winding unit 25 for winding the medium M, onto which printing is performed by the printing unit 40, and that is discharged outside the housing 13.

In the printer 10 according to the present exemplary embodiment, the feeding portion 20 and the winding unit 25 are provided outside the housing 13, and the support portion 30, the transport unit 50, and the printing unit 40 are provided inside the housing 13.

The feeding portion 20 includes a holding unit 21 provided on a rear surface side (a side of a +Y direction in FIG. 2) of the printer 10, and holding a roll body R around which the medium M is wound in a cylindrical shape. The holding unit 21 is attached to the foot 12 and rotatably holds the roll body R. Moreover, the feeding portion 20 rotates the roll body R in one direction (a counterclockwise direction in FIG. 2) to feed the medium M from the roll body R toward the inside of the housing 13.

The support portion 30 supports the medium M from a lower side (a side of a −Z direction in FIG. 2), and includes a first support portion 31, a second support portion 32, and a third support portion 33. The first support portion 31, the second support portion 32, and the third support 33 are provided side by side from the rear surface side of the printer 10 to a front surface side (a side of a −Y direction in FIG. 2) that is opposite thereto, and the first support portion 31 and the third support portion 33 of the support portions are provided such that a part of each the support portion is exposed outside the housing 13. Then, the first support portion 31 guides the medium M fed from the feeding portion 20 to the second support portion 32, the second support portion 32 guides the medium M guided from the first support portion 31 to the third support portion 33, and the third support portion 33 guides the medium M guided from the second support portion 32 to the winding unit 25.

In other words, a transport path through which the medium M is transported is formed by the first support portion 31, the second support portion 32, and the third support portion 33, so as to extend from the rear surface side of the printer 10 toward the front surface side. Additionally, the first support portion 31 and the second support portion 32 are attached to a base member 35 provided inside the housing 13.

The printing unit 40 includes a guide shaft 41 extending in the X direction, a carriage 42 supported by the guide shaft 41, and a plurality of discharging heads 43 for discharging ink onto the medium M. The carriage 42 is provided so as to be movable reciprocally in the X direction along the guide shaft 41. The plurality of discharging heads 43 are arranged in the X direction. Each of the plurality of discharging heads 43 is capable of discharging ink corresponding to any one color of four colors (cyan, magenta, yellow, and black). The discharging head 43 is held by the carriage 42 so as to oppose to the medium M supported by the second support portion 32. Since the carriage 42 moves along the guide shaft 41, and ink of different colors are discharged from the plurality of discharging heads 43 respectively, the printing unit 40 is capable of printing a full color image on the medium M. Each of the plurality of discharging heads 43 includes a nozzle plate (not illustrated) formed with a plurality of nozzles (not illustrated) for discharging ink.

Note that, the discharging head 43 is an example of a discharging unit of the present application.

The winding unit 25 is provided on the front surface side of the printer 10, and has a holding unit 26 for holding the roll body R formed by winding the medium M in the cylindrical shape. The holding unit 26 is attached to the foot 12, and rotatably holds the roll body R. Then, the winding unit 25 rotates the roll body R in the one direction (counterclockwise direction in FIG. 2), and the medium M on which printing is performed by the printing unit 40 is wound.

The transport unit 50 includes a transport roller pair 51 provided between the first support portion 31 and the second support portion 32 in the transport path constituted by the support portion 30, and a transport roller pair 52 provided between the second support portion 32 and the third support portion 33.

Note that, in the present exemplary embodiment, the printer 10 including two number of the transport roller pairs 51 and 52 is illustrated, but a configuration may be adopted in which the printer 10 includes a single transport roller pair, or a configuration may be adopted in which the printer 10 has three or more transport roller pairs.

The transport roller pairs 51 and 52 each has a driving roller 56 that contacts the medium M from the lower side, and a driven roller 57 that contacts the medium M from an upper side (a side of a +Z direction in FIG. 2).

In each of the transport roller pairs 51 and 52, a motor (not illustrated) that is a power source of the driving roller 56 is driven to rotate the driving roller 56. The driven roller 57 rotates in association with the rotation of the driving roller 56. In each of the transport roller pairs 51 and 52, the medium M is transported along the transport path, with the driving roller 56 and the driven roller 57 sandwiching the medium M.

FIG. 3 to FIG. 7 are perspective views each illustrating an overview of the liquid supply device 100 according to the present exemplary embodiment.

Figure 3:
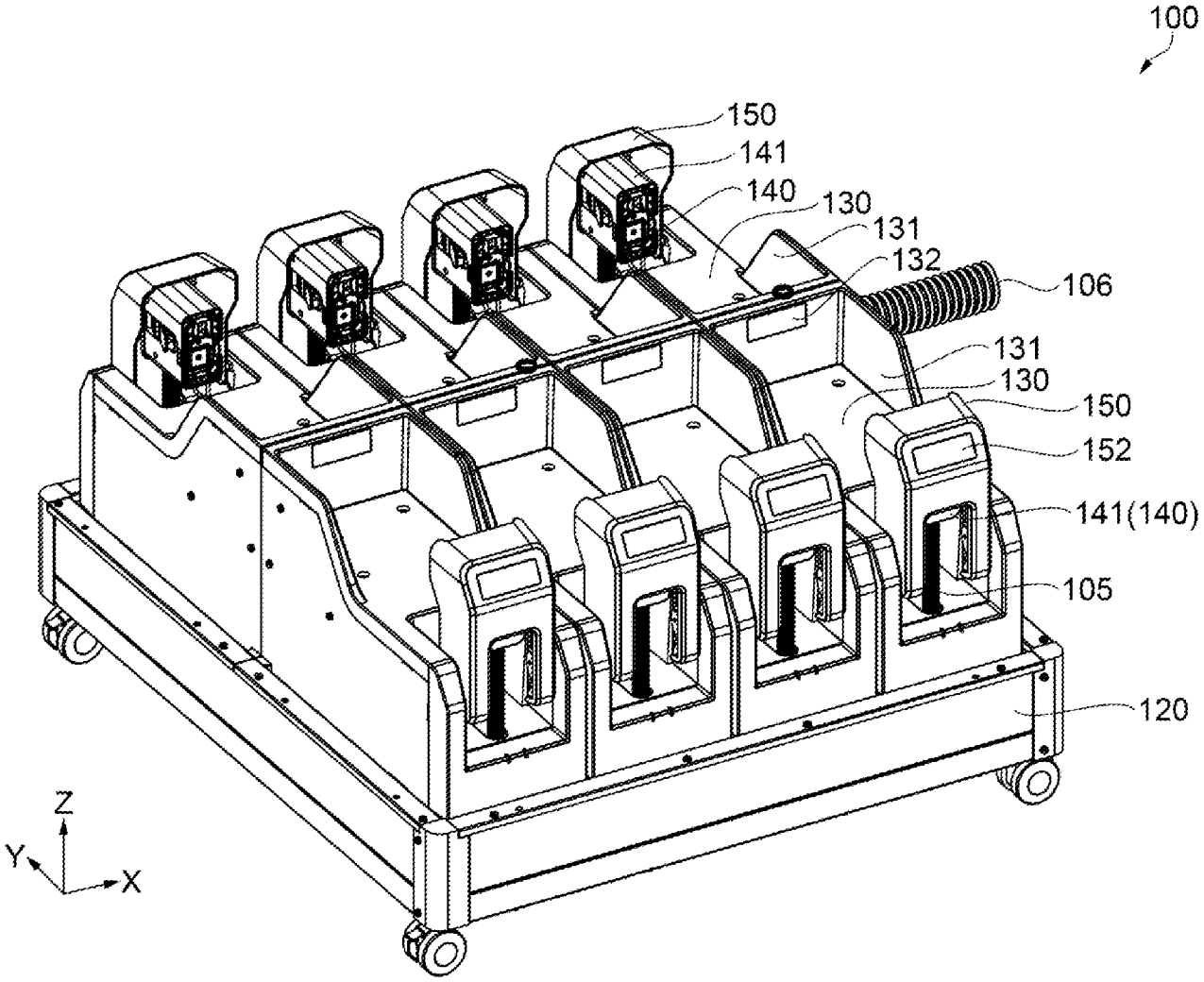
FIG. 3 is a perspective view illustrating an overview of a liquid supply device according to the exemplary embodiment.
Figure 4:
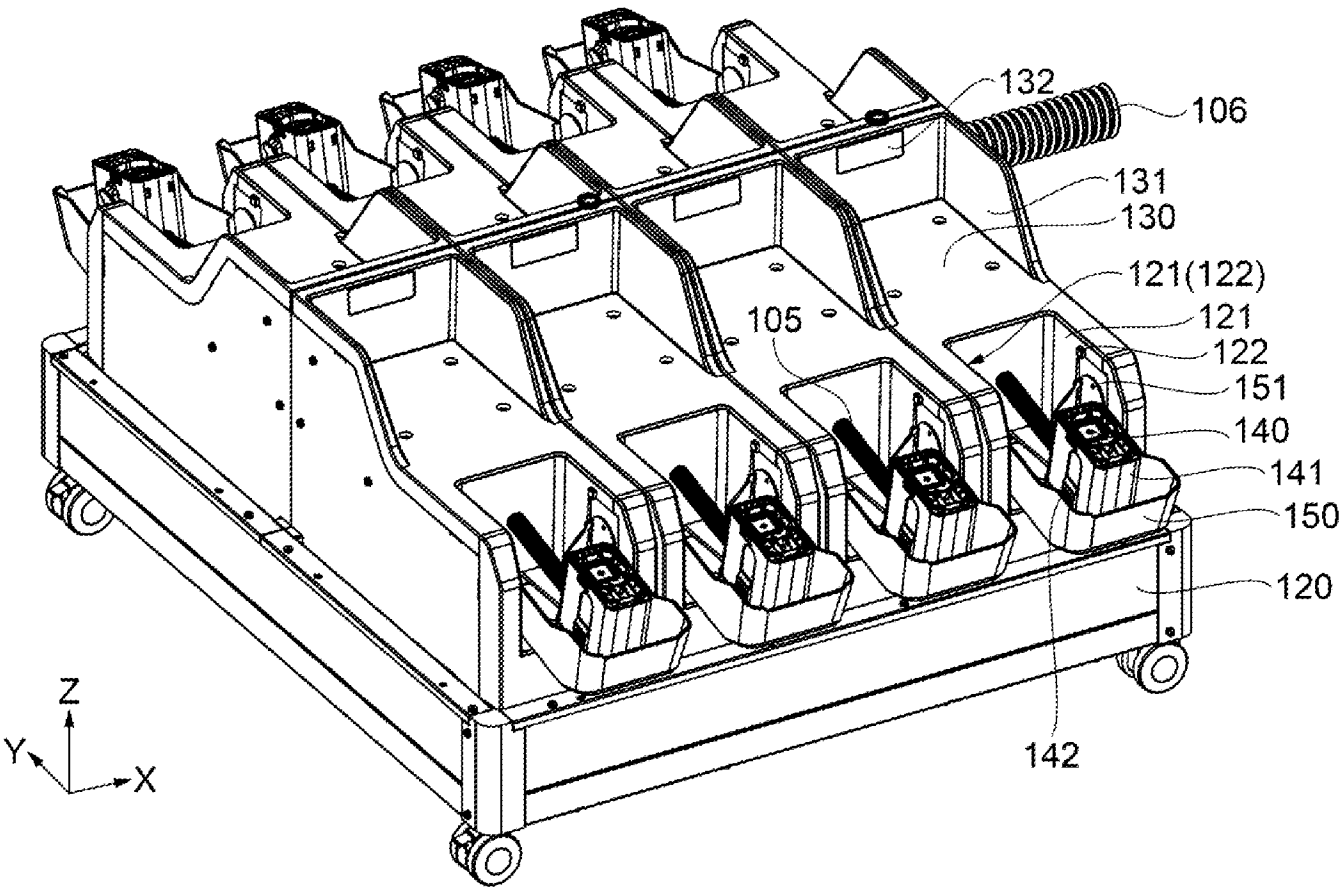
FIG. 4 is a perspective view illustrating an overview of the liquid supply device according to the exemplary embodiment.
Figure 5:
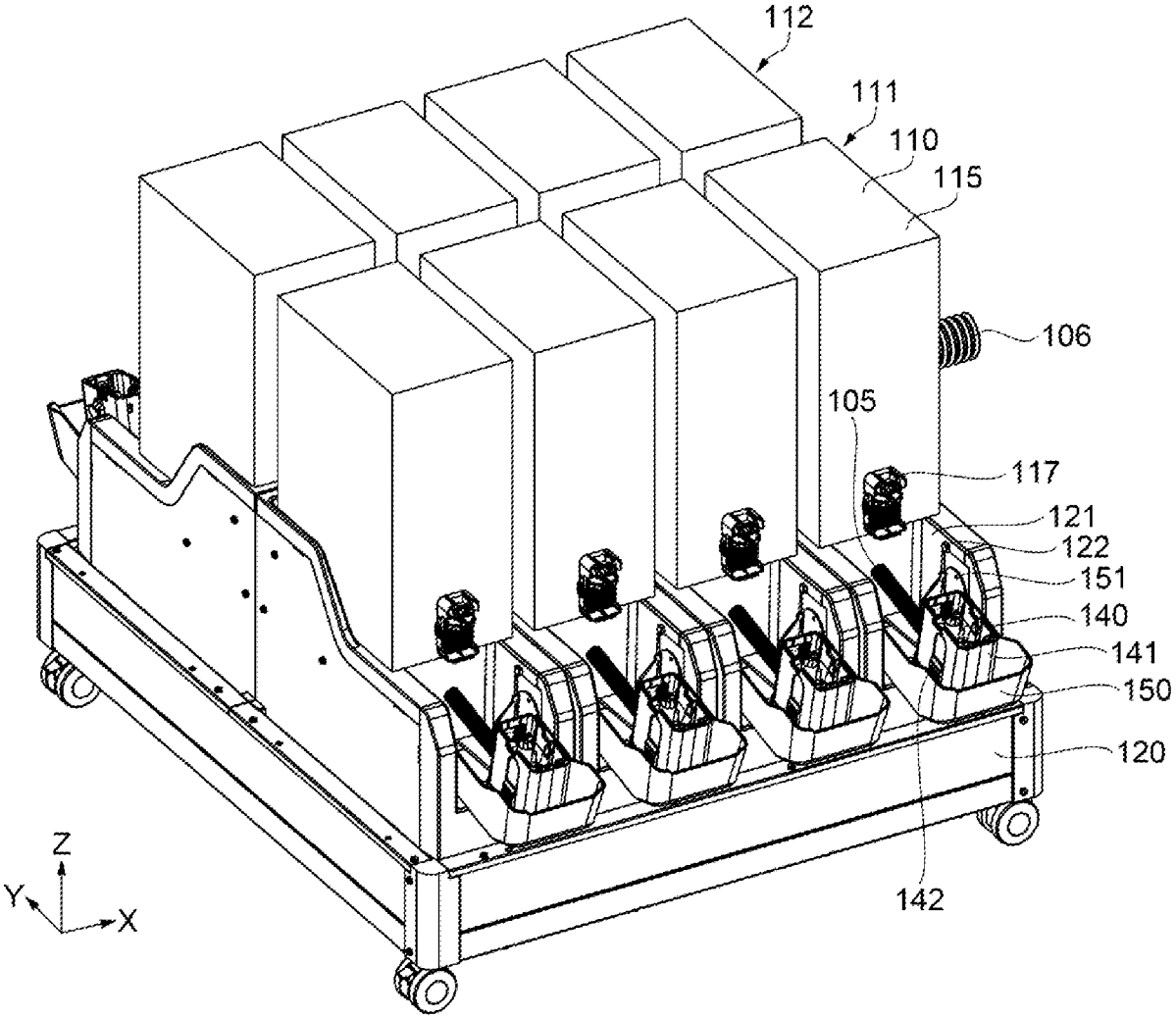
FIG. 5 is a perspective view illustrating an overview of the liquid supply device according to the exemplary embodiment.
Figure 6:
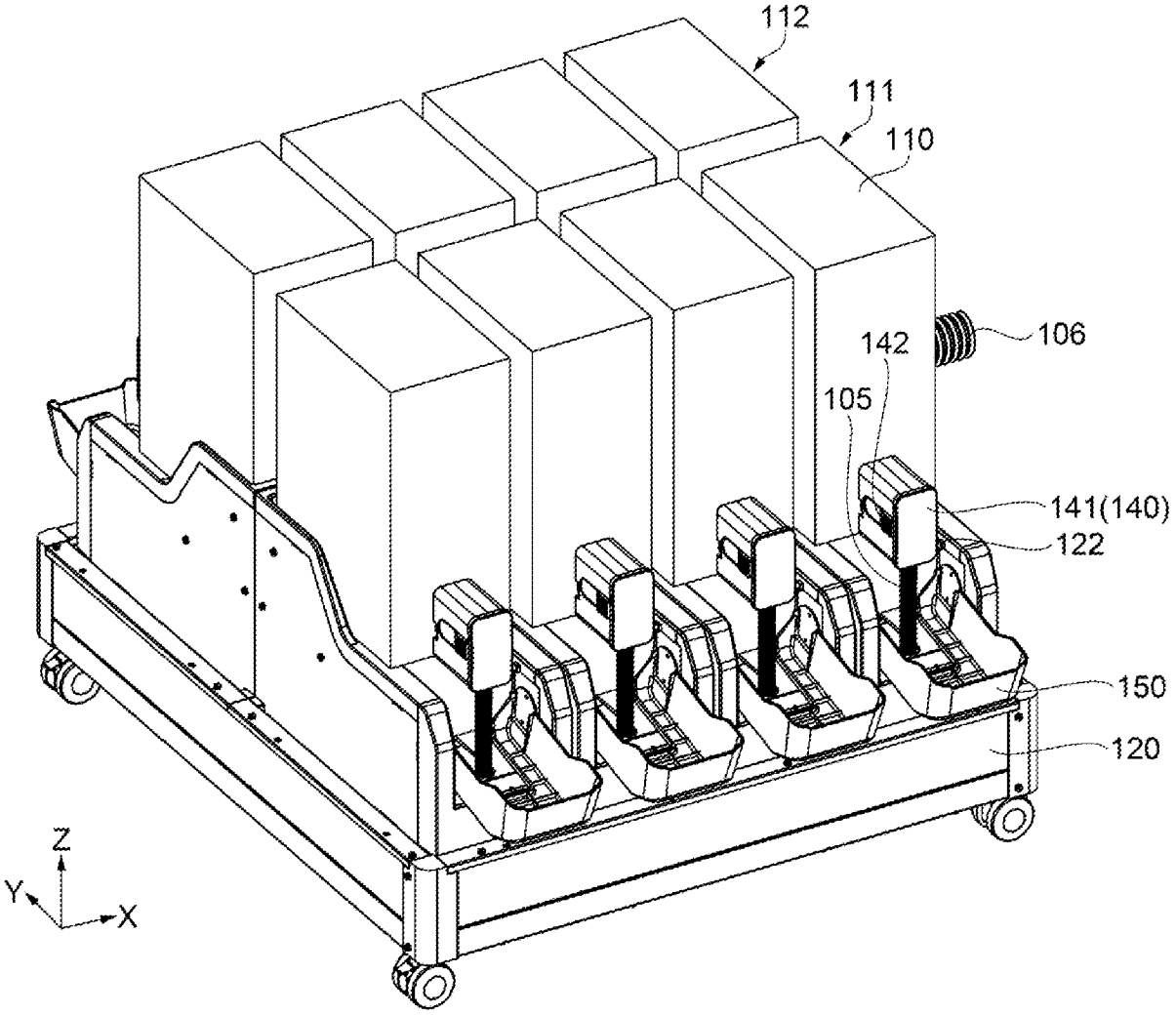
FIG. 6 is a perspective view illustrating an overview of the liquid supply device according to the exemplary embodiment.
Figure 7:
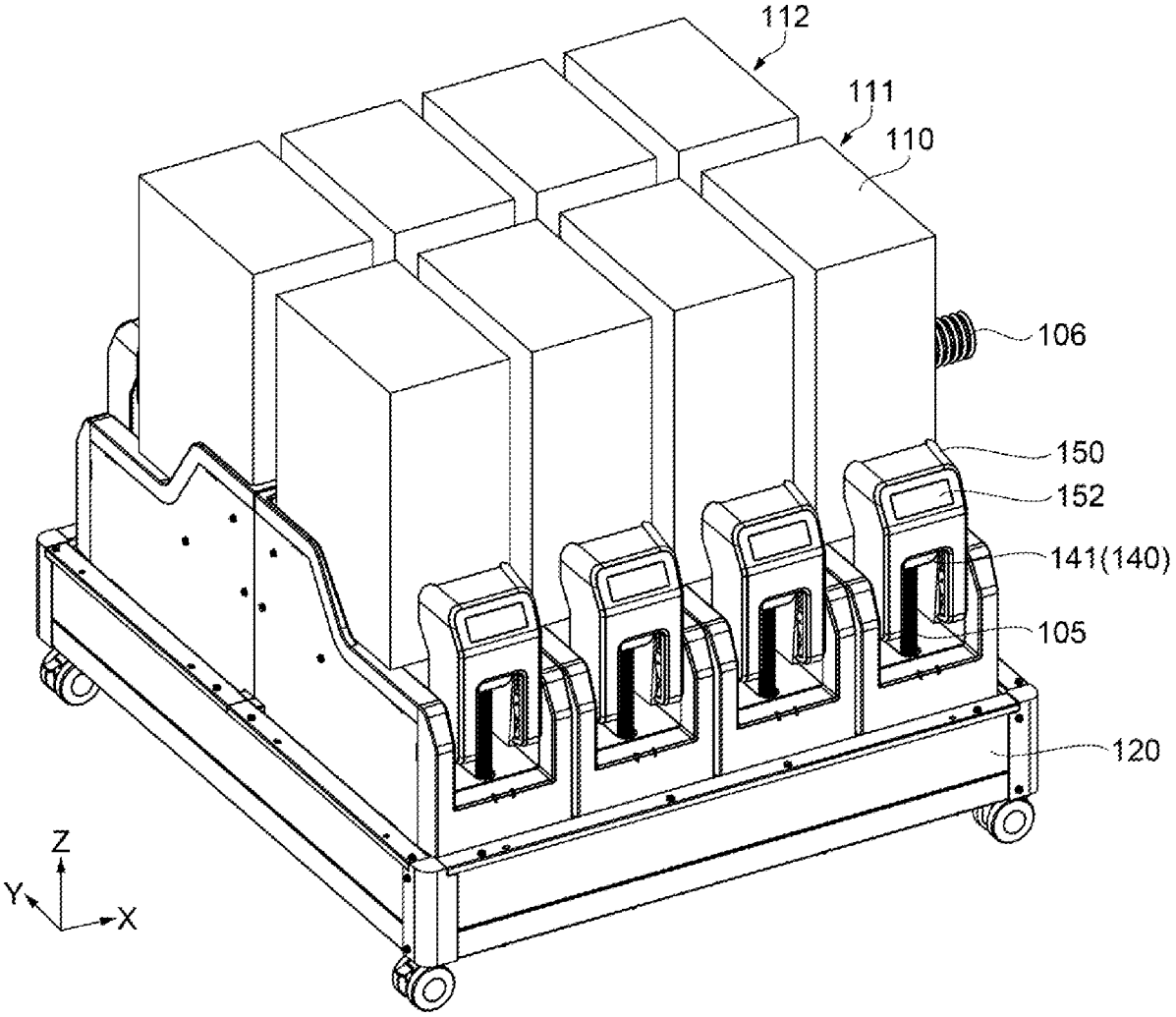
FIG. 7 is a perspective view illustrating an overview of the liquid supply device according to the exemplary embodiment.

In FIG. 3 and FIG. 4, no storing body 110 is mounted on the liquid supply device 100, and the storing body 110 is mounted on the liquid supply device 100 in FIG. 5 to FIG. 7. In addition, a cover 150 is disposed so as to protect a connector 140 in FIG. 3 and FIG. 7, and the cover 150 is disposed so as to expose the connector 140 in F 4 to FIG. 6.

In the following description, when the cover 150 is disposed so as to cover the connector 140, the cover 150 is referred to as being in a closed state, and when the cover 150 is disposed so as to expose the connector 140, the cover 150 is referred to as being in an open state.

Next, an overview of the liquid supply device 100 according to the present exemplary embodiment will be described with reference to FIG. 1 and FIG. 3 to FIG. 7.

As illustrated in FIG. 1, in the printer system 1, the printer 10 is coupled to the liquid supply device 100 via a plurality of tubes 105 (eight number of the tubes 105 in the present exemplary embodiment). The plurality of tubes 105 are piped in a thick protective tube 106, and protected by the thick protective tube 106.

The tube 105 and protective tube 106 are flexible and bendable. Thus, the printer 10 and the liquid supply device 100 are movable in a range in which the tube 105 and the protective tube 106 are bendable.

In the present exemplary embodiment, a longitudinal direction of the liquid supply device 100 is aligned with the X direction, and a short direction of the liquid supply device 100 is aligned with the Y direction, and a height direction of the liquid supply device 100 is aligned with the Z direction.

In the liquid supply device 100 according to the present exemplary embodiment, a first storing body 111 and a second storing body 112 are mounted. Each of a plurality of the first storing bodies 111 and each of a plurality of the second storing bodies 112 stores ink corresponding to any one color of the four colors. In other words, at least one number of the first storing bodies 111 and at least one number of the second storing bodies 112 can be mounted on the liquid supply device 100 according to the present exemplary embodiment.

The at least one number of the first storing bodies 111 include a storing body 111K for storing a black ink, a storing body 111C for storing a cyan ink, a storing body 111M for storing a magenta ink, and a storing body 111Y for storing a yellow ink.

In a state in which the first storing bodies 111 are mounted on the liquid supply device 100, the storing body 111K for storing the black ink, the storing body 111C for storing the cyan ink, the storing body 111M for storing the magenta ink, and the storing body 111Y for storing the yellow ink are disposed in order in the X direction.

The at least one number of the second storing bodies 112 include a storing body 112K for storing the black ink, a storing body 112C for storing the cyan ink, the storing body 112M for storing the magenta ink, and a storing body 112Y for storing the yellow ink.

In a state in which the second storing bodies 112 are mounted on the liquid supply device 100, the storing body 112K for storing the black ink, the storing body 112C for storing the cyan ink, the storing body 112M for storing the magenta ink, and the storing body 112Y for storing the yellow ink are disposed in order in the X direction.

In the printer system 1, the ink stored in each of the four storing bodies 111K, 111C, 111M, and 111Y, or the ink stored in each of the four storing bodies 112K, 112C, 112M, 112Y is supplied to the discharging head 43 of the printer 10 via the tube 105.

In the following description, each of the storing bodies 111K, 111C, 111M, and 111Y, and the storing bodies 112K, 112C, 112M, and 112Y may be referred to as the storing body 110.

In the liquid supply device 100, a portion where the first storing body 111 is mounted and a portion where the second storing body 112 is mounted are in a surface-symmetric relationship with respect to an XZ plane and have identical structure to each other. Thus, in the following description, the portion where the first storing body 111 of the liquid supply device 100 is mounted will be described, and a description of the portion of the liquid supply device 100 where the second storing body 112 is mounted will be omitted.

As illustrated in FIG. 3 to FIG. 7, the liquid supply device 100 includes a support portion 120, a mounting base 130 on which the storing body 110 filled with ink is mountable, the tube 105 capable of supplying the ink from the storing body 110 to the printer 10, the connector 140 coupled to the tube 105 and detachable from the storing body 110, and the cover 150 for protecting the connector 140. Furthermore, the liquid supply device 100 has a detector 151 (see FIG. 4) for detecting a position of the cover 150.

As illustrated in FIG. 5, the storing body 110 includes an outer packaging case 115 constituted by cardboard, an ink storing container (not illustrated) disposed inside the outer packaging case 115, and a connection aperture 117 coupled to the ink storing container and protruding outward the outer packaging case 115. The ink storing container is constituted by a polyethylene resin, for example, so as not to be eroded by the ink.

Furthermore, the storing body 110 is provided with a semiconductor substrate (not illustrated) in which information about the ink stored in the ink storing container is stored.

Referring back to FIG. 3 to FIG. 7, the mounting base 130 is supported by the support portion 120 disposed below the the mounting base (in the −Z direction) in the height direction. In other words, the mounting base 130 is supported by the support portion 120 from lower side in the height direction. In the liquid supply device 100, when the storing body 110 is mounted on the mounting base 130, a position of the mounting base 130 and a position of the connector 140 are adjusted such that the connection aperture 117 of the storing body 110 and the connector 140 can be coupled to each other.

A wall portion 131 extending upward (the +Z direction) in the height direction is provided around the mounting base 130. The wall portion 131 abuts on the storing body 110 mounted on the mounting base 130 to regulate movement of the storing body 110. In other words, the wall portion 131 provided on the mounting base 130 is an example of a second regulating portion in the present application.

Since the wall portion 131 is provided, the storing body 110 is made less likely to move on the mounting base 130, and is stably mounted on the mounting base 130.

A label 132 with which a color of the ink stored in the storing body 110 mounted on the mounting base 130 can be identified is affixed to the wall portion 131. Similarly, a label 152 with which a color of the ink stored in the storing body 110 mounted on the mounting base 130 can be identified is affixed to the cover 150 as well.

Specifically, the labels 132 and 152 for black are affixed to respective locations where the storing body 110 for storing the black ink is mounted, the labels 132 and 152 for cyan are affixed to respective locations where the storing body 110 for storing the cyan ink is mounted, the labels 132 and 152 for magenta are affixed to respective locations where the storing body 110 for storing the magenta ink is mounted, and the labels 132 and 152 for yellow are affixed to a location where the storing body 110 for storing the yellow ink is mounted. A user can identify a type of the storing body 110 mounted on the mounting base 130 with the color of the labels 132 and 152.

A wall portion 121 extending upward in the height direction (+Z direction) is provided around the cover 150 in the support portion 120. The cover 150 is disposed inside the wall portion 121 and is supported by the wall portion 121 so as to be rotatable in the Z direction. In a state in which the connector 140 is coupled to the connection aperture 117 of the storing body 110, the cover 150 is disposed at a position for covering a grip portion 141 of the connector 140 illustrated in FIG. 7, or a position for exposing the grip portion 141 of the connector 140 illustrated in FIG. 6.

Note that, the position illustrated in FIG. 7 for the cover 150 to cover the grip portion 141 of the connector 140, that is, the position of the cover 150 when the cover 150 is in the closed state, corresponds to a first position for covering the grip portion in the present application, and is hereinafter referred to as the first position. The position illustrated in FIG. 6 for the cover 150 to expose the grip portion 141 of the connector 140, that is, the position of the cover 150 when the cover 150 is in the open state, corresponds to a second position for not covering the grip portion in the present application, and is hereinafter referred to as the second position.

In this manner, the cover 150 is movable to the first position for covering the grip portion 141 of the connector 140, and to the second position for not covering the grip portion 141 of the connector 140, in a state in which the connector 140 is attached to the storing body 110 mounted on the mounting base 130. Furthermore, the cover 150 rotates with an axis along the X direction being a rotational movement axis with respect to the mounting base 130, thus the cover 150 can move to the first position and the second position.

The connector 140 is a coupler for liquid coupled to the connection aperture 117 of the storing body 110. One part of the connector 140 is coupled to the connection aperture 117 of the storing body 110, and another part of the connector 140 is coupled to the tube 105. As a result, since the connector 140 is coupled to the connection aperture 117 of the storing body 110, the ink in the storing body 110 is supplied to the printer 10 via the connector 140 and the tube 105.

The connector 140 includes the grip portion 141 that is an outer packaging case. The user grips the grip portion 141 to rotate the connector 140 in the Z direction. The connector 140 is provided with a lever 142 that locks a coupling state between the connector 140 and the connection aperture 117 of the storing body 110, or releases the coupling state between the connector 140 and the connection aperture 117 of the storing body 110.

Furthermore, the connector 140 includes a coupling member (not illustrated) that can be electrically coupled to the semiconductor substrate provided on the storing body 110. When the connector 140 is coupled to the connection aperture 117 of the storing body 110, the semiconductor substrate provided on the storing body 110 is electrically coupled to the control device 11 via this coupling member. As a result, the control device 11 can acquire the information about the ink stored in the storing body 110.

Note that, a shape of the cover 150 is arbitrary as long as it is possible to protect a portion where the connection aperture 117 of the storing body 110 and the connector 140 are coupled to each other. For example, the shape of the cover 150 may be semi-spherical or semi-cylindrical.

Additionally, the cover 150 may also be provided so as to protect only the lever 142. In other words, it is sufficient that the cover 150 has structure that satisfies at least one of a condition that the portion where the connection aperture 117 of the storing body 110 and the connector 140 are coupled to each other is protected, and a condition that the lever 142 is protected.

In the state in which the connector 140 is coupled to the connection aperture 117 of the storing body 110, the wall portions 121 of the support portion 120 are disposed so as to sandwich the grip portion 141 (a coupling portion between the connection aperture 117 of the storing body 110 and the connector 140). In other words, in the state in which the connector 140 is coupled to the connection aperture 117 of the storing body 110, the support portion 120 has a pair of the wall portions 121 disposed so as to sandwich the grip portion 141.

A convex portion 122 (see FIG. 4) is provided on each of the pair of wall portions 121 that protrudes inward the pair of wall portions 121. The convex portion 122 is contactable with the cover 150. When the user rotates the cover 150 and disposes the cover 150 at the first position for covering the grip portion 141, movement of the cover 150 is regulated such that the cover 150 does not contact the connector 140. In other words, the wall portion 121 is provided with the convex portion 122 that is contactable with the cover 150, and capable of regulating contact of the cover 150 with the connector 140 coupled to the storing body 110, at the first position for covering the grip portion 141 of the connector 140.

Note that, the convex portion 122 is an example of the regulating portion in the present application.

The detector 151 is a so-called torque switch, attached to the wall portion 121 of the support portion 120, and detects the position of the cover 150. In the detector 151, a configuration is adopted in which, when the cover 150 is in the closed state, an actuator of this torque switch is pressed, and when the cover 150 is in the open state, the pressing of the actuator of this torque switch is released. Then the control device 11 detects open or close of the cover 150 based on a signal supplied from the detector 151.

In the liquid supply device 100 according to the present exemplary embodiment, when an amount of the ink stored in the storing body 110 becomes small, the user removes the connector 140 from the storing body 110 storing the small amount of ink, and removes the storing body 110 storing the small amount of ink from the mounting base 130. Next, the user mounts a new storing body 110 on the mounting base 130, and attaches the connector 140 to the new storing body 110.

Next, an operation by the user for replacing the storing body 110 storing a small amount of ink with a new storing body 110 will be described.

When an amount of the ink stored in the storing body 110 becomes small, the user rotates the cover 150 and disposes the cover 150 at the second position for not covering the grip portion 141 (see FIG. 6). Subsequently, the user moves the lever 142 to a position where the coupling state between the connector 140 and the connection aperture 117 of the storing body 110 can be released, and removes the connector 140 from the connection aperture 117 of the storing body 110 (see FIG. 5). Subsequently, the user removes the storing body 110 storing the small amount of ink from the mounting base 130 (see FIG. 4).

In the present exemplary embodiment, the cover 150 is configured to be capable of supporting the connector 140 removed from the storing body 110 mounted on the mounting base 130, at the second position. In other words, when the cover 150 is disposed at the second position for not covering the grip portion 141, and the connector 140 is removed from the connection aperture 117 of the storing body 110, the cover 150 supports the connector 140 such that the connector 140 removed from the storing body 110 does not fall in the −Z direction.

If, the cover 150 is not provided, and the connector 140 removed from the storing body 110 falls in the −Z direction, extra force is applied to a coupling portion between the connector 140 and the tube 105, thus there is a possibility that the coupling between the connector 140 and the tube 105 may be released. Furthermore, when the coupling between the connector 140 and the tube 105 is released, air may be supplied to the discharging head 43 of the printer 10. In a case in which air is supplied to the discharging head 43 of the printer 10, and when ink is discharged from the discharging head 43, air is discharged from a nozzle, of a plurality of nozzles, that is to discharge the ink, which leads to defects in ink dots. There is a possibility that the defects in ink dots may deteriorate image quality.

In the present exemplary embodiment, the connector 140 removed from the storing body 110 is supported by the cover 150 and does not fall in the −Z direction, and extra force is unlikely to be applied to the coupling portion between the connector 140 and the tube 105, thus, for example, occurrence of a defect that the coupling between the connector 140 and the tube 105 is released, air is supplied to the discharging head 43 of the printer 10, and image quality deteriorates is suppressed.

Next, the user mounts a new storing body 110 on the mounting base 130 (see FIG. 5). Subsequently, the user couples the connector 140 to the connection aperture 117 of the storing body 110 (see FIG. 6). Subsequently, the user moves the lever 142 to a position where a coupling state between the connector 140 and the connection aperture 117 of the storing body 110 is locked.

The user then rotates the cover 150 to dispose the cover 150 at the first position for covering the grip portion 141 (see FIG. 7). Then, at least one of the connector 140 and a portion where the connector 140 and the connection aperture 117 of the storing body 110 are coupled to each other is brought into a state of being protected by the cover 150.

When the user rotates the cover 150, the convex portion 122 provided on the wall portion 121 regulates movement of the cover 150 such that the cover 150 does not contact the grip portion 141 of the connector 140. Accordingly, even when the user rotates the cover 150 and disposes the cover 150 at the first position for covering the grip portion 141, no extra force is applied to the portion where the connector 140 and the connection aperture 117 of the storing body 110 are coupled to each other. Furthermore, the portion where the connector 140 and the connection aperture 117 of the storing body 110 are coupled to each other is locked by the lever 142, and is protected by the cover 150, thus a defect that the coupling between the connector 140 and the connection aperture 117 of the storing body 110 is released is less likely to occur, and the ink stored in the storing body 110 is stably supplied to the printer 10.

In the liquid supply device 100 according to the present exemplary embodiment, in addition to the first storing bodies 111 storing the four colors of ink, the second storing bodies 112 for storing the four colors of ink are mounted, and a supply source of the ink to the printer 10 can be switched to the first storing bodies 111 or the second storing bodies 112.

For example, when the black ink is supplied to the printer 10 from the storing body 111K, that is an example of the first storing body 111, and an amount of the black ink in the storing body 111K becomes small, a supply source of the black ink can be switched such that the black ink is supplied from the storing body 112K that is an example of the second storing body 112.

For example, when the black ink is supplied to the printer 10 from the storing body 112K, that is the example of the second storing body 112, and an amount of the black ink in the storing body 112K becomes small, the supply source of the black ink can be switched such that the black ink is supplied from the storing body 111K that is the example of the first storing body 111.

As for each of the cyan ink, the magenta ink, and the yellow ink as well, as in the case of the black ink, a supply source of the ink to the printer 10 may be switched to the first storing body 111 or the second storing body 112.

The supply source of the ink to the printer 10 is switched by a manual operation by the user, or is switched automatically, in some cases. Next, a case in which the supply source of the ink to the printer 10 is automatically switched will be described.

In the printer system 1 according to the present exemplary embodiment, when detecting that the cover 150 moves to the second position for not covering the grip portion 141 by a signal from the detector 151, the control device 11 automatically stops supply of the ink to the printer 10 from the storing body 110. Subsequently, the control device 11 automatically switches the supply source of the ink to the printer 10 from the first storing body 111 to the second storing body 112.

For example, when the black ink is supplied to the printer 10 from the storing body 111K that is the example of the first storing body 111, an amount of the black ink in the storing body 111K becomes small, and in order to remove the connector 140 from the storing body 111K, the user moves the cover 150 corresponding to the connector 140 coupled to the storing body 111K to the second position, then the control device 11 detects that the cover 150 moves to the second position for not covering the grip portion 141 by a signal from the detector 151, and automatically stops the supply of the black ink from the storing body 111K. Subsequently, the control device 11 automatically switches the supply source of the ink to the printer 10 from the storing body 111K that is the example of the first storing body 111, to the storing body 112K that is the example of the second storing body 112.

As for each of the cyan ink, the magenta ink, and the yellow ink as well, as in the case of the black ink, when the user, in order to remove the connector 140 from the storing body 110 that is the example of the first storing body 111, moves the cover 150 to the second position, the control device 11 automatically stops supply of the ink from the storing body 110 that is the example of the first storing body 111, and automatically switches the supply source of the ink to the printer 10, from the storing body 110 that is the example of the first storing body 111, to the storing body 110 that is an example of the second storing body 112.

Similarly, as for each of the black ink, the cyan ink, the magenta ink, and the yellow ink, the user, in order to remove the connector 140 from the storing body 110 that is the example of the second storing body 112, moves the cover 150 corresponding to the connector 140 coupled to each of the storing body 111C, the storing body 111M, and the storing body 111Y to the second position, then the control device 11 automatically stops supply of the ink from the storing body 110 that is the example of the second storing body 112, and automatically switches the supply source of the ink to the printer 10, from the storing body 110 that is the example of the second storing body 112, to the storing body 110 that is the example of the first storing body 111.

With this configuration, when the supply source of the ink to the printer 10 is switched from the first storing body 111 to the second storing body 112, the printer 10 does not stop, downtime of the printer 10 is shortened, and productivity of the printer 10 is enhanced. Similarly, when the supply source of the ink to the printer 10 is switched from the second storing body 112 to the first storing body 111, the printer 10 does not stop, and downtime of the printer 10 is shortened, and productivity of the printer 10 is enhanced.

Additionally, since the supply of the ink to the printer 10 is automatically stopped, and the supply source of the ink to printer 10 is automatically switched, compared to a case in which supply of the ink to the printer 10 is manually stopped, and the supply source of the ink to the printer 10 is manually switched, a negative effect due to operational errors by the user is eliminated, and for example, a defect that the ink leaks outside due to an operational error is suppressed.

In addition, when the user, in order to remove the connector 140 from the storing body 110, moves the cover 150 to the second position, and exposes a coupling portion between the storing body 110 and the connector 140, there is a possibility that extra force is applied to the coupling portion between the storing body 110 and the connector 140, the coupling between the storing body 110 and the connector 140 is released, air is mixed into the tube 105, and this mixed air is supplied to the printer 10.

In the present exemplary embodiment, when the cover 150 is moved to the second position, the supply of the ink from the storing body 110 to the printer 10 is automatically stopped, thus, even if the coupling between the storing body 110 and the connector 140 is released, and air is mixed into the tube 105, this mixed air is not supplied to the printer 10.

The disclosure is not limited to the above-described exemplary embodiments, but can be changed appropriately without departing from the idea or the gist of the disclosure which can be appreciated from the claims and the entire specification, and a variety of modifications other than the above-described exemplary embodiments are conceivable. Hereinafter modifications will be described.

Modification 1

A configuration may be adopted in which the printer system 1 according to the above-described exemplary embodiment is used as a printer in the present application, and this printer includes the printer 10 according to the above-described exemplary embodiment (a main body of a printer in the present modification) and the liquid supply device 100 (a liquid supply device for the printer in the present modification).

In other words, the printer according to the present application may be configured to include the mounting base 130 on which the storing body 110 filled with ink is mountable, the tube 105 capable of supplying the ink from the storing body 110, the connector 140 coupled to the tube 105, detachable from the storing body 110, and provided with the grip portion 141, and the cover 150 movable to a first position for covering the grip portion 141, and a second position for not covering the grip portion 141, in a state in which the connector 140 is attached to the storing body 110 mounted on the mounting base 130, and the discharging head 43 capable of discharging the ink supplied from the storing body 110 onto the medium M.

Modification 2

The control device 11 for controlling supply of ink from the liquid supply device 100 may be provided in the liquid supply device 100 instead of being provided in the printer 10. Furthermore, a personal computer may be provided separately from the printer 10 and the liquid supply device 100, and the control device 11 for controlling supply of ink from the liquid supply device 100 may be provided in this personal computer.

Modification 3

In the exemplary embodiment described above, the cover 150 is rotatable with the axis along the X direction as the rotational movement axis, but the cover 150 may be rotatable with an axis along the Z direction as a rotational movement axis. Furthermore, the cover 150 need not be single opening that rotates in one direction, but may be, for example, double opening that rotates from a center toward both sides. Furthermore, the cover 150 may be slidable in the X direction, the Y direction, or the Z direction. Furthermore, the cover 150 may be detachable from the support portion 120 or the mounting base 130.

Modification 4

In the exemplary embodiment described above, the detector 151 is the torque switch, but may be an optical sensor or a magnetic sensor.

Modification 5

In the exemplary embodiment described above, ink capacity of the first storing body 111 may be different from ink capacity of the second storing body 112.

Contents derived from the exemplary embodiment will be described below.

A liquid supply device is a liquid supply device for use in a printer, that includes a mounting base on which a storing body filled with liquid, a tube capable of supplying the liquid from the storing body to the printer, a connector coupled to the tube and configured to be detached from the storing body, and moreover provided with a grip portion, and a cover configured to move to a first position for covering the grip portion and a second position for not covering the grip portion, in a state in which the connector is attached to the storing body mounted on the mounting base.

The connector is a coupler for liquid that is detachable from the storing body. The grip portion is an outer packaging case of the connector and forms a part of the connector. For example, when the cover is disposed at the second position, a coupling portion between the storing body and the connector is exposed, thus the coupling between the storing body and the connector can be released to replace the storing body with a new storing body. For example, when the cover is disposed at the first position, the coupling portion between the storing body and the connector is protected by the cover, and the coupling between the storing body and the connector is less likely to be released, thus it is possible to suppress a defect that liquid leaks from the storing body.

In the above liquid supply device, the cover may move to the first position and the second position by the cover rotating relative to the mounting base.

When the cover is rotated to move to the first position and the second position, for example, compared to a case in which the cover slides to move to the first position and the second position, a movable range of the cover can be narrowed, thus the liquid supply device can be compactified.

In the above liquid supply device, the cover may be configured to support, at the second position, the connector detached from the storing body mounted on the mounting base.

The connector removed from the storing body for replacement with a new storing body is supported by the cover, thus, for example, a defect is unlikely to occur that when the connector is removed from the storing body, the connector falls, extra force is applied to a coupling portion between the connector and the tube, and coupling between the connector and the tube is released.

The above liquid supply device may include a support portion that supports the mounting base from lower side in a height direction, the support portion may be provided with a wall portion extending upward in the height direction, and the wall portion may be provided with a regulating portion configured to regulate contact of the cover with the connector coupled to the storing body at the first position.

When the cover is rotated between the first position and the second position, and the cover is disposed at the first position, the regulating portion regulates contact of the cover with the connector coupled to the storing body, thus, a defect is unlikely to occur that extra force is applied to the coupling portion between the storing body and the connector, and the coupling between the connector and the tube is released.

In the above liquid supply device, the mounting base may be provided with a second regulating portion that abuts on the storing body mounted on the mounting base and is capable of regulating movement of this storing body.

When the storing body is mounted on the mounting base, the second regulating portion regulates movement of the storing body, thus the storing body is made to be stably mounted on the mounting base. Accordingly, a defect is unlikely to occur that the storing body moves, extra force is applied to the coupling portion between the storing body and the connector, and the coupling between the connector and the tube is released.

A printer system of the present application includes a liquid supply device including a mounting base on which a storing body filled with liquid, a tube capable of supplying the liquid from the storing body, a connector coupled to the tube and configured to be detached from the storing body, and moreover provided with a grip portion, and a cover configured to move to a first position for covering the grip portion and a second position for not covering the grip portion, in a state in which the connector is attached to the storing body mounted on the mounting base, and a printer including a discharging unit configured to discharge liquid, supplied from the liquid supply device, onto a medium.

In the liquid supply device, when the cover movable to the first position and the second position is provided, a coupling portion between the storing body and the connector is protected by the cover disposed at the first position, and the coupling between the storing body and the connector is made unlikely to be released, thus a defect that liquid leaks from the storing body is suppressed. Thus, the liquid can be stably supplied to the printer from the liquid supply device.

The above printer system may include a control device configured to control supply of the liquid to the printer, the liquid supply device may include a detector configured to detect a position of the cover, the control device may, when the detector detects that the cover moved to the second position, stop supply of the liquid from the storing body to the printer.

When the cover is moved to the second position, to expose the coupling portion between the storing body and the connector, there is a possibility that extra force is applied to the coupling portion between the storing body and the connector, the coupling between the storing body and the connector is released, air is mixed into the tube, and this mixed air is supplied to the printer. When the cover is moved to the second position, supply of the liquid from the storing body to the printer is stopped, thus, even when the coupling between the storing body and the connector is released, and air is mixed into the tube, this mixed air is unlikely to be supplied to the printer.

In the above printer system, when the storing body is a first storing body, the mounting base is configured to mount thereon a second storing body, and the control device may be configured to control the liquid supply device so as to switch, when the detector detects that the cover moved to the second position, from the first storing body to the second storing body, a source of the supply of the liquid to the printer.

For example, when a residual amount of the liquid in the first storing body becomes small, and in order to switch the supply source of the liquid from the first storing body to the second storing body, the cover on a side of the first storing body is moved to the second position, while supply of the liquid from the first storing body is stopped, the supply source of the liquid to the printer can be switched from the first storing body to the second storing body. Accordingly, when the supply source of the liquid to the printer is switched from the first storing body to the second storing body, printing will not stop, thus productivity of the printer system can be increased.

A printer of the present application includes a mounting base on which a storing body filled with liquid, a tube capable of supplying the liquid from the storing body, a connector coupled to the tube and configured to be detached from the storing body, and moreover provided with a grip portion, a cover configured to move to a first position for covering the grip portion and a second position for not covering the grip portion, in a state in which the connector is attached to the storing body mounted on the mounting base, and a discharging unit configured to discharge the liquid, supplied from the storing body, onto a medium.

When the cover that can be disposed at the first position and the second position is provided, a coupling portion between the storing body and the connector is protected by the cover disposed at the first position, and the coupling between the storing body and the connector is made unlikely to be released, thus a defect that liquid leaks from the storing body is suppressed.

What is claimed is:

1. A liquid supply device for use in a printer, comprising:

a mounting base on which a storing body filled with liquid is mountable;

a tube configured to supply the liquid from the storing body to the printer;

a connector coupled to the tube and configured to be detached from the storing body, and moreover provided with a grip portion that is configured to allow a user to move the connector; and a cover configured to move to a first position for covering the grip portion and a second position for not covering the grip portion, in a state in which the connector is attached to the storing body mounted on the mounting base.

2. The liquid supply device according to claim 1, wherein the cover moves to the first position and the second position by the cover rotating relative to the mounting base.

3. The liquid supply device according to claim 2, wherein the cover is configured to support, at the second position, the connector detached from the storing body mounted on the mounting base.

4. The liquid supply device according to claim 3, comprising a support portion configured to support the mounting base from lower side in a height direction, wherein the support portion is provided with a wall portion extending upward in the height direction, and the wall portion is provided with a regulating portion configured to contact the cover, and configured to regulate contact of the cover with the connector coupled to the storing body at the first position.

5. The liquid supply device according to claim 1, wherein the mounting base is provided with a second regulating portion that abuts on the storing body mounted on the mounting base, and is configured to regulate movement of the storing body.

6. A printer system, comprising:

a liquid supply device including a mounting base on which a storing body filled with liquid is mountable, a tube configured to supply the liquid from the storing body, a connector coupled to the tube and configured to be detached from the storing body, and moreover provided with a grip portion that is configured to allow a user to move the connector, and a cover configured to move to a first position for covering the grip portion and a second position for not covering the grip portion, in a state in which the connector is attached to the storing body mounted on the mounting base; and a printer including a discharging unit configured to discharge the liquid, supplied from the liquid supply device, onto a medium.

7. The printer system according to claim 6, comprising a control device configured to control supply of the liquid to the printer, wherein the liquid supply device includes a detector configured to detect a position of the cover, and the control device, when the detector detects that the cover moved to the second position, stops supply of the liquid from the storing body to the printer.

8. The printer system according to claim 7, wherein when the storing body is a first storing body, a second storing body is mountable on the mounting base, the control device is configured to control the liquid supply device so as to switch, when the detector detects that the cover moved to the second position, from the first storing body to the second storing body, a source of supply of the liquid to the printer.

9. A printer, comprising:

a mounting base on which a storing body filled with liquid is mountable;

a tube configured to supply the liquid from the storing body;

a connector coupled to the tube and configured to be detached from the storing body, and moreover provided with a grip portion that is configured to allow a user to move the connector;

a cover configured to move to a first position for covering the grip portion and a second position for not covering the grip portion, in a state in which the connector is attached to the storing body mounted on the mounting base; and a discharging unit configured to discharge the liquid, supplied from the storing body, onto a medium.

* * * * *